US006817407B2

(12) United States Patent
Wagner et al.

(10) Patent No.: US 6,817,407 B2
(45) Date of Patent: Nov. 16, 2004

(54) HEAT EXCHANGER WITH MULTIPLE EXCHANGER BLOCKS WITH UNIFORM FLUID DISTRIBUTION SUPPLY LINE AND REBOILER-CONDENSER COMPRISING SUCH AN EXCHANGER

(75) Inventors: Marc Wagner, Saint Maur des Fosses (FR); François Fuentes, Le Vesinet (FR); Zhijie Chen, Creteil (FR)

(73) Assignee: L'Air Liquid—Societe Anonyme a Directoire et Conseil de Surveillance pour l'Etude et l'Exploitation des Procedes Georges Claude, Paris Cedex (FR)

( * ) Notice: Subject to any disclaimer, the term of this patent is extended or adjusted under 35 U.S.C. 154(b) by 230 days.

(21) Appl. No.: 09/923,396

(22) Filed: Aug. 8, 2001

(65) Prior Publication Data

US 2002/0023739 A1 Feb. 28, 2002

(30) Foreign Application Priority Data

Aug. 8, 2000 (FR) ..... 00 10433

(51) Int. Cl.[7] ..... F28F 3/00
(52) U.S. Cl. ..... 165/166; 165/145; 165/174
(58) Field of Search ..... 165/166, 174, 165/145

(56) References Cited

U.S. PATENT DOCUMENTS 3,256,704 A * 6/1966 Becker ..... 165/166
3,590,914 A * 7/1971 Duncan ..... 165/166
3,623,505 A 11/1971 Barsness et al.
3,830,292 A 8/1974 Wolowodiuk et al.
4,276,927 A * 7/1981 Foust ..... 165/166
4,330,308 A * 5/1982 Grenier et al. ..... 165/166
5,107,923 A 4/1992 Sherman et al.
5,186,249 A * 2/1993 Bhatti et al. ..... 165/174
5,284,203 A * 2/1994 Dauvergne ..... 165/174
5,671,808 A * 9/1997 Kleyn ..... 165/174
5,979,544 A * 11/1999 Inoue ..... 165/174

FOREIGN PATENT DOCUMENTS

EP 0 826 528 3/1998

* cited by examiner

*Primary Examiner*—Leonard R. Leo
(74) *Attorney, Agent, or Firm*—Young & Thompson

(57) ABSTRACT

In such an exchanger, in which the blocks have fluid inlet openings in communication with the interior space of a supply box which runs alongside the block and communicates with at least one analogous box of an adjacent block to form a fluid supply line, in order to even out the distribution of fluid between the openings of the blocks, the supply line contains at least one grating (30) leaving perforations (301) and solid parts (302) which are distributed in such a way as to create pressure drops which are such that the flow velocities of the fluid in the inlet openings downstream of the grating have similar values.

19 Claims, 2 Drawing Sheets

HEAT EXCHANGER WITH MULTIPLE EXCHANGER BLOCKS WITH UNIFORM FLUID DISTRIBUTION SUPPLY LINE AND REBOILER-CONDENSER COMPRISING SUCH AN EXCHANGER

BACKGROUND OF THE INVENTION

The invention relates to heat exchangers, particularly for reboiler-condensers of cryogenic installations, for example main reboiler-condensers of double air distillation columns and to reboiler-condensers comprising such an exchanger.

BRIEF DESCRIPTION OF THE DRAWINGS

A reboiler-condenser equipped with such an exchanger is depicted in FIGS. 1 and 3, in which:

FIG. 6 shows a grating for extending over the entire area of a cross section of the line.

DESCRIPTION OF THE PREFERRED EMBODIMENT

Figure 2:
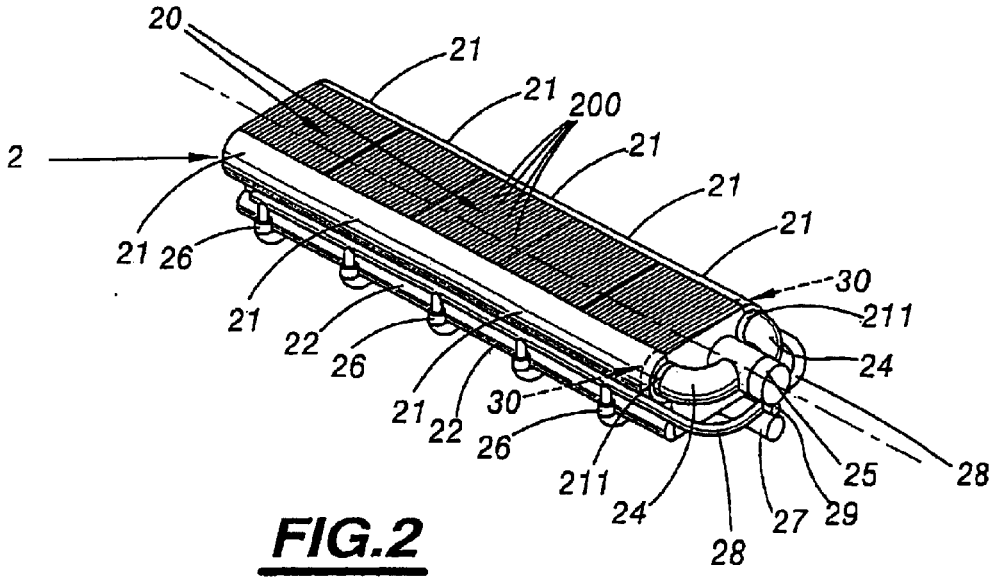
FIG. 2 is a schematic exterior perceptive view of an exchanger internally equipping the reboiler-condenser of FIG. 1.

This reboiler-condenser 1, intended to condense a first fluid arriving in the gaseous state while vaporising a second fluid arriving in the liquid state thus comprises, inside vessel 10 of cylindrical overall shape, a heat exchanger 2 as depicted in FIG. 2.

The reboiler-condenser illustrated in the figures comprises a single vessel but reboiler-condensers commonly comprise several vessels, for example two parallel vessels, each equipped with an exchanger.

In order to bring the second fluid in the liquid state into the cylindrical vessel 10, the central region of one of the bases 101 thereof is equipped with a supply pipe 11; the central region of the opposite base is equipped with a discharge pipe, not visible in the drawings, for discharging from the vessel that part of the second fluid which has not been vaporised following exchange of heat with the first fluid. The upper part of the side wall of the vessel is equipped with at least one discharge pipe 12 for discharging from the vessel that part of the second fluid which has been vaporised and is thus in a gaseous state.

Inside the vessel 10, the heat exchanger 2 is thus immersed in bath 13 consisting of that part of the second fluid which is in the liquid state, on top of which there is a gas headspace 14 consisting of that part of the second fluid which has been vaporised following heat exchange with the first fluid, conveyed through the exchanger.

Figure 3:
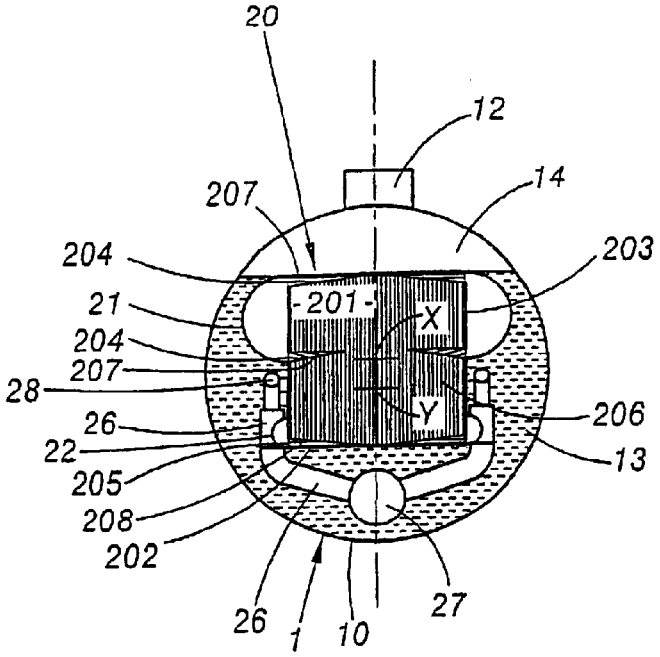
FIG. 3 is a schematic cross section through the reboiler-condenser of FIG. 1.

The exchanger 2 depicted in FIG. 2 and visible also in FIG. 3 comprises an exchanger body consisting of several exchanger blocks 20 with plates arranged in line and back to back and arranged to condense the first fluid by causing it to circulate through substantially vertical passages of the exchanger blocks from the top downwards, vaporising the second fluid which circulates through passages adjacent to those in which the first fluid circulates, from the bottom upwards.

To this end, each exchanger block 20 has plates 200, generally rectangular ones, arranged parallel to each other and spaced apart by corrugated spacers which act as thermal fins, so as to form a stack of parallelepipedal shape, assembled by brazing. The plates 200 thus, in pairs, define passages intended for the circulation, in the vertical direction of, alternating from one end plate of the block to the opposite end plate, the first fluid and the second fluid.

The plates which between them delimit a rectangular passage 201 for the first fluid (FIG. 3) are also spaced apart by strips running along their four sides; whereas the strips 202 on the horizontal sides extend the entire length of the sides, the strips 203 on the vertical side do not extend as far as the ends of these sides and have an approximately central break in them so as to create openings 204 at the upper ends and mid-way up the passages, and openings 205 at the lower ends of the passages, constituting inlet and outlet accesses, respectively, for the first fluid.

The plates which between them delimit a passage for the second fluid (not depicted in detail in the drawings) are spaced apart by strips running only along their vertical sides, over the entire length of the sides, so as, along the entire length of their lower and upper horizontal sides, to create inlet and outlet openings, respectively, for the second fluid.

In order to duct the second fluid through the passages intended for it in the block 20, the corrugated spaces which extend through the passages have vertical generatrices.

The passages 201 intended for the first fluid in the blocks 20 comprise a main heat exchange region 206, inlet distribution regions 207 extending near the inlet openings 204, and outlet collection regions 208 near the outlet openings 205. The inlet distribution regions 207 and the outlet collection regions 208 here are in the form of right-angled triangles; the right-angled triangles forming two of the four inlet distribution regions have, respectively, as their vertex right-angles, the upper right-hand corners of the rectangular passage for the first fluid, as the short sides of the right-angles they have the heights of the upper inlet openings 204, and as the long sides of the right angles they have the half-widths of the passage at the tops of these openings; the right-angled triangles of the other two inlet distribution regions have, respectively, as the short sides of the right angle, the heights of the inlet openings 204 mid-way up the passage and, as the long sides of the right angles, approximately two-thirds of the half-width of the passage at the tops of these openings; the right-angled triangles forming the two outlet collection regions have, respectively, as their vertex right angles, the lower right-hand corners of the rectangular passage for the first fluid, as the short sides of the right angles they have the heights of the outlet openings 205, and of the long sides of the right angles they have the half widths of the passage at the base of the openings.

In order to duct the first fluid through the passages 201 intended for it in the blocks 20, the corrugated spacers which extend through the inlet distributor regions 207 and the outlet collection regions 208 have horizontal generatrices, while the corrugated spacers which extend through the main heat-exchange regions 206 have vertical generatrices.

Thus, each exchanger block 20 has four series of inlet openings 204 for the first fluid, extending, two by two, respectively in two vertical parallel faces of the block and opening in four respective series of inlet distributor regions 207, two series of outlet openings 205 for the first fluid extending respectively in the same two faces and into which two respective series of outlet collecting regions 208 open, a series of inlet openings for the second fluid extending in a lower horizontal face of the block, and a series of outlet openings for the second fluid extending in an upper horizontal face of the block.

As the exchanger blocks 20 are immersed in the second fluid and the passages thereof for it have this second fluid passing through them from their inlet openings to their outlet openings coming from the supply pipe 11, the first fluid is circulated through a system of pipework connected to the exchanger block as described below.

In general, each of the series of inlet openings has its openings 204 in communication with the interior space of a respective fluid supply box 21 carried by the block 20, of elongate shape, which runs alongside the face of the block in which face the series of openings is created; likewise, each of these series of outlet openings 205 has its openings in communication with the interior space of a respective fluid discharge box 22 carried by the block 20, of elongate shape, which runs alongside the face of the block in which face the series of openings (205) is created.

The supply boxes 21 and the discharge boxes 22 have a cross section at right angles to their axis which is in the shape of a circular sector: in this instance, the cross section is in the shape of a semicircle, and the boxes have a semi-cylindrical wall and are open along the diametral plain of the half-cylinder via which the openings open into the interior space of the box.

The two series of inlet openings situated in one and the same face of a block open into the same supply box 21, at the top and bottom thereof, respectively.

Figure 4:
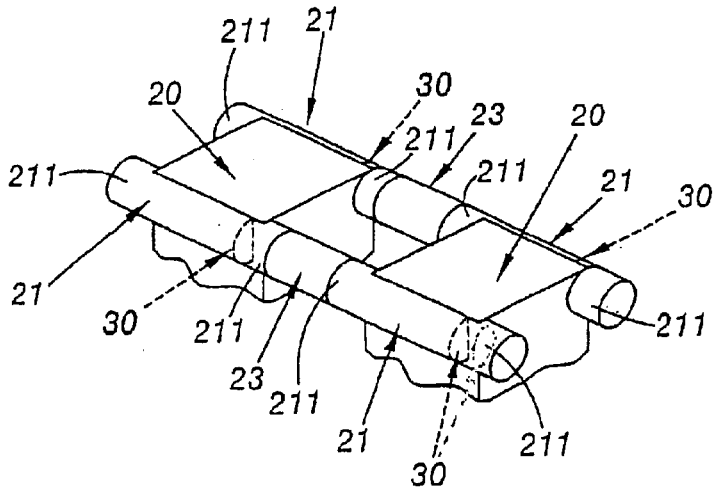
FIG. 4 is a schematic exterior perspective view of the part of another possible embodiment of an exchanger for internally equipping the reboiler-condenser of FIG. 1.

The analogous supply boxes 21 of the adjacent blocks are in communication with one another to form a fluid supply line and the analogous discharge boxes 22 of the adjacent blocks are in communication with one another to form a fluid discharge line, either through the fact that the analogous boxes of the various blocks constituting one and the same exchanger body are made of a single piece (FIG. 2) or because the analogous boxes, which are equipped on each side of each block 20 with cylindrical tappings 211 have their respective tappings, which lie facing each other, connected by a connecting piece 23 (FIG. 4).

It will be noted that the supply boxes of the end block 20 of an exchanger have no downstream tapping and have a semicircular end wall whereas the supply boxes made of a single piece of an exchanger have one upstream tapping 211 to make them easier to connect (FIG. 2).

More specifically, the upstream tappings 211 of the two supply lines for supplying first fluid in the gaseous state which are situated one on each side of the exchanger, are connected to elbowed inlet pipes 24, themselves connected on each side of an inlet manifold 25 passing through the base 101 of the vessel 10, via which the first fluid is introduced in the gaseous state.

By contrast, the discharge lines for discharging the first fluid in the gaseous state are shut off at both ends; facing each block 20, the side wall of each box 22 has an aperture via which the interior space of the box opens into a respective discharge pipe 26 running in an approximately vertical plane, part of which extends downwards below the box, being elbowed in such a way as to continue under the block 20 transversely to the latter and inclined downwards; the lower ends of all the discharge pipes 26 situated on each side of the blocks 20 opening into one and the same discharge manifold 27 which collects the first fluid in the liquid state, which passes through the base 101 of the vessel 10. Each discharge pipe 26 also has a part extending upwards above the level of the box 22, and the upper ends of all the discharge pipes 26 open into one or other of two discharge pipes 28 for discharging uncondensable or uncondensed residual gases and which run horizontally, on each side of the exchanger respectively, along the exchanger; these residual gas discharge pipes 28 are situated at a level which is someway between that of the supply boxes 21 and that of the discharge boxes 22; at the upstream end of the exchanger, they open into a residual gas discharge manifold 29 which also passes through the base 101 of the vessel 110.

In a reboiler-condenser such as this, the first fluid, conveyed in the gaseous state to the inlet manifold 25, is distributed between the two inlet pipes 24, then enters the line of supply boxes 21 which follow on from one another along the line of blocks 20; from there, it enters, via the inlet openings 204, the passages 201 intended for it between the plates. Then, the second fluid, conveyed in the liquid state by the supply pipe 11 into the vessel 10 and forming therein a bath 13 in which the exchange boxes 20 are immersed receives enough energy for some of this second fluid to vaporise while the first fluid, giving up some of its energy, liquefies. The first fluid, liquefied, leaves the exchanger blocks 20 via the outlet openings 205 at the base of the blocks, enters the discharge boxes 22, and drops down through the discharge pipes 26 into the discharge manifold 27 via which it is discharged from the reboiler-condenser. In general, when the first fluid arrives in the reboiler-condenser in the gaseous state, it is not completely pure and contains a fraction of gas that cannot be condensed at the operating temperature of the reboiler-condenser; the uncondensable or uncondensed residual gases are carried into the discharge boxes 22 with the first fluid in the liquid state, but escape from the boxes 22 through the discharge pipes 26, upwards, into the residual gas discharge pipes 28 and are discharged from the reboiler-condenser by the uncondensed gas discharge manifold 29. At the same time, that part of the second fluid which is passing in the gaseous state through the passages intended for it in the block 20, escapes from these passages through the upper openings thereof, and is discharged from the vessel 10 where it constitutes the ceiling 14, through the discharge pipes.

One problem which arises in a reboiler-condenser such as this is that of universally distributing the first fluid in the gaseous state between the passages 201 of the various exchanger blocks.

What happens is that the flow of the first fluid through the supply boxes 21 is very non-uniform and can even become locally turbulent as a result, for example, of the passage from the cross section at right angles to the axis which is circular in the inlet pipes 24 to the cross section at right angle to the axis which is semicircular in the boxes 21 and, then considering a cross section through the boxes at right angles to their axis, the velocities at various locations very close to one another in this section may be extremely different. This results in an unequal distribution of the first fluid between the various inlet openings 204 and thus between the various passages 201 for the first fluid, often a lower flow rate through the openings closest to the tappings. One consequence of this poor distribution is a disparity in the conversion of the first fluid into a gas in the various passages 201, and thus reboiler-condenser efficiency which is not optimal.

It is an object of the invention to overcome this drawback, and the invention therefore relates to a heat exchanger comprising an exchanger block or a number of aligned exchanger blocks, where fluids are circulated in a heat-exchange relationship, at least one face of each block containing inlet openings for at least one of the fluids, the inlet openings in the same face of each block for this fluid being in communication with the interior space of the same fluid supply box which runs alongside the said face thereof, and which communicates with at least one analogous box of an adjacent block if there is one, to form a fluid supply line, the exchanger being characterized in that the fluid supply line contains at least one grating arranged across the line and having through-perforations and solid parts which are distributed in such a way as to create, at locations on the surface of the grating, pressure drops which are such that the flow velocities of the fluid in the inlet openings downstream of the grating have similar values, and the distribution of the fluid in the inlet openings and in the supply line downstream of the grating and upstream in the vicinity thereof, is approximately uniform.

By virtue of the grating, the optimum location and optimum position of which can be chosen according to the three lines in the box, it is possible to regain good uniformity of distribution of the velocities through the boxes and thus an approximately uniform distribution of the first fluid in the various passages intended for it in the blocks.

The exchanger according to the invention may furthermore exhibit one or more of the following features:

- the grating has perforations distributed non-uniformly over its surface;
- the grating has through-perforations with a degree of perforations on its surface which varies over this surface approximately in the opposite direction to the value of the flow velocities at the locations in the absence of the grating;
- the degree of perforation varies over the surface of the grating substantially in inverse proportion to the flow velocities at the same locations in the absence of the grating;
- the grating has several juxtaposed regions each having the same degree of perforation on their surfaces, and respective degrees of perforation that differ from one region to an adjacent region;
- the grating has at least one region consisting of a notch or a cut-out;
- the grating has at least one continuous region with no perforations representing a substantial fraction of its area;
- the grating extends over a cross section of the line;
- the grating extends over a cross section of the line at right angles to its axis;
- the grating is arranged at an angle in the supply line;
- the grating extends over the entire area of a cross section of the line;
- the grating extends over an area smaller than a cross section of the line;
- the heat exchanger comprises a supply line having a tapping exhibiting a circular cross section at right angles to its axis, which is connected to supply boxes having a semicircular cross section at right angles to their axis, and the grating is arranged in a supply box near the tapping.
- the supply line contains several gratings;
- the heat exchanger comprises two supply lines and each line contains at least one grating; and
- the said fluid circulating through the fluid supply line is in the gaseous state.

The invention also relates to reboiler-condensers, particularly of air separation units, comprising such an exchanger.

Figure 1:
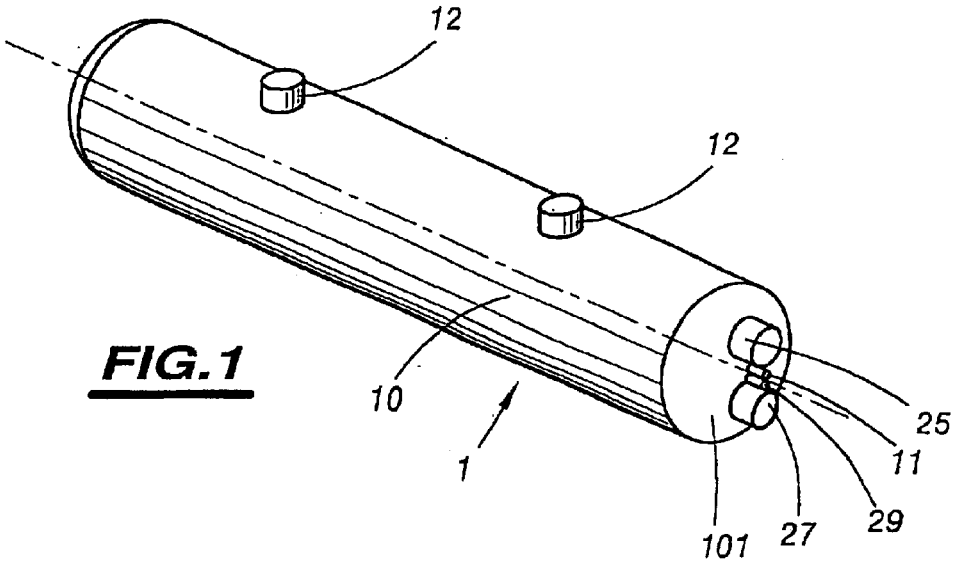
FIG. 1 is a schematic exterior view of a reboiler-condenser which can be equipped internally with an exchanger arranged according to the invention.
Figure 5:
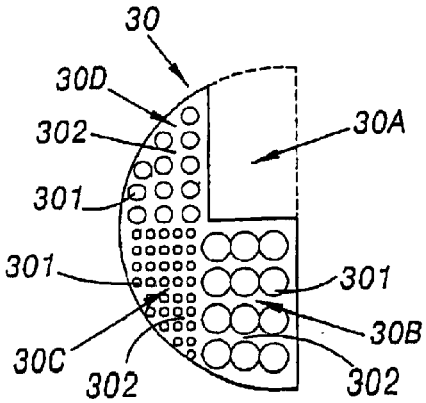
FIG. 5 is a front view of one embodiment of an equalizing grating designed, according to the invention, to be fitted to a fluid supply line of an exchanger such as the one in FIGS. 2 and 4.

Other features and advantages of the invention will become apparent from the description which will follow of one embodiment of the invention given by way of non-limiting example, and illustrated by the appended FIGS. 4 and 5, in which:

FIG. 4 is a schematic exterior perspective view of the part of another possible embodiment of an exchanger for internally equipping the reboiler-condenser of FIG. 1, and FIG. 5 is a front view of one embodiment of an equalizing grating designed, according to the invention, to be fitted to a fluid supply line of an exchanger such as the one in FIGS. 2 and 4.

As the reboiler-condenser and the exchanger according to the invention are as per the description given hereinabove, apart from the fact that those described earlier have no equalizing grating, they will not be described again in detail.

Such reboiler-condensers equip, in particular, cryogenic air distillation installations in which they are associated with and connected to a double distillation column comprising a low-pressure column superposed on a medium-pressure column, to liquefy gaseous nitrogen tapped off from the top of the medium-pressure column by exchange of heat with liquid oxygen which is found at the foot of the low-pressure column and which is vaporised in the reboiler-condenser.

If reference is made to the foregoing description of the reboiler-condenser, the nitrogen constitutes the first fluid which is introduced into the exchanger in the gaseous state via the inlet manifold 25 and which is then discharged in the liquid state via the discharge manifold 27, and the oxygen is the second fluid introduced into the vessel 10 in the liquid state via the supply pipe 11, part of which can be drawn off in the liquid state by a discharge pipe, not depicted, and another part of which is discharged in the gaseous state to one or more discharge pipes 12.

Rare gases of the air, which cannot be condensed at the operating temperature of the reboiler-condenser are almost inevitably mixed with the gaseous nitrogen introduced into the exchanger; these gases are discharged in the gaseous state through the uncondensed gas discharge manifold 29.

In order to even out the flow in the supply line for the first fluid, in this case gaseous nitrogen, comprising the succession of supply boxes 12 to a sufficient extent for the flow velocities in the inlet openings downstream of the grating to have similar values, and thus even out the distribution of fluid between the inlet openings, this line contains one or more straight or curved gratings 30 arranged across the path of the fluid through the line, at an optimum location tailored to the stream lines in this line.

In general, this grating or these gratings 30 have through perforations 301 and solid parts 302 which are distributed so as to create, at locations on the surface of the grating, pressure drops which are such that the flow velocities of the fluid in adjacent zones belonging to one and the same cross section at right angles to the axis of the fluid supply line downstream of the grating have similar values and such that the distribution of the fluid in the inlet openings 204 of all the blocks 20 supplied by this line is approximately uniform.

For example, a grating 30 such as this may have through perforations and solid parts distributed approximately uniformly at its surface so that the presence of the grating introduces a significant uniform pressure drop across the entire fluid flow section.

However, in order to obtain the deficiency, it is generally desirable for the pressure drop in the line to be as low as possible, and it is generally advantageous for the degree of perforation of the surface of the grating 30 which is defined as being, for a given region of the grating, the ratio of the area occupied by the perforations 301 to the total area of the region, to vary over the region or from one region from another in the opposite direction to the value of the flow velocities at the same locations in the supply line in the absence of a grating.

For example, the degree of perforation varies from one region to another of the surface of the grating substantially in inverse proportion to the flow velocities at the same locations in the absence of the grating.

In general, a single grating 30 arranged in a semi-cylindrical upstream region of the supply line, near the cylindrical tapping 211 (FIGS. 2 and 4), whose transition with the semi-cylindrical region is, to a large extent, in the observed non-uniformity, is sufficient to regain the desired uniformity. If, in the absence of a grating, there is a turbulent region in the box immediately downstream of the tapping, the grating may advantageously often be arranged in this turbulent region.

Nonetheless, it is sometimes necessary for the grating to be arranged further downstream in line, or even for several identical or non-identical gratings to be fitted, for example one grating in each box 21 near the inlet thereof.

The grating 30 depicted in FIG. 5, of semicircular overall shape is intended to be fitted in the semi-cylindrical part of the line at right angles to the longitudinal axis thereof, has, by way of example, four regions having different degrees of perforation, namely a region with a unit degree of perforation 30A (cut-out) near the upper part of the faces of the blocks 20 against which the box is fitted, a region 30B with a relatively high degree of perforation, also near this face at the lower part of the grating, a region 30C with a low degree of perforation beside the region with the high degree of perforation, that is to say opposite the said face of the block, and a region 30D with an intermediate degree of perforation above the region with the low degree of perforation; in this instance, the perforations 301 are circular and the degree of perforation rises with the diameter of the perforations, but these perforations could have any appropriate shape, particularly that of a regular polygon, and it is possible to obtain a region with a low degree of perforation using large-sized perforations if these perforations are few in number and, conversely, as has been seen, it is possible to obtain a region with a maximum degree of perforation (that is to say one equal to 1) by creating in the grating a notch or cut-out the area of which is that of this region, or by arranging in the supply line a grating the area of which is smaller than the cross section of the line, it is also possible to provide regions with a zero degree of perforation, that is to say continuous regions without perforations, representing substantial sections of the area of the grating.

It is also possible to arrange the grating not on a cross section at right angles to the axis but at an angle to the supply line, and to make it act as a deflector, for example directed downstream in the direction of the cylindrical surface of the box; if the boxes are, as they generally are, semi-cylindrical, and if the grating occupies the entire area of an inclined section of a box, the grating has a semi-elliptical exterior shape.

The case depicted in the figures, in which the exchanger has two supply lines for conveying the fluids to the openings 204 of the opposite faces of the blocks 20, it may be desirable for the gratings 30 not to be arranged symmetrically in the two lines, particularly if the distribution of the flow in the lines is not symmetrical.

What is claimed is:

1. Heat exchanger (2) comprising an exchanger block or a number of aligned exchanger blocks (20), where fluids are circulated in a heat-exchange relationship, at least one face of each block comprising inlet openings (204) for at least one of the fluids, the inlet openings in the same face of each block for this fluid being in communication with the interior space of the same fluid supply box (21) which runs alongside the face thereof, and which communicates with at least one analogous box of an adjacent block if there is one, to form a fluid supply line, the exchanger being characterized in that the fluid supply line contains at least one grating (30) arranged across the line and having through-perforations (301) and solid parts (302) which are distributed in such a way as to create, at locations on the surface of the grating, pressure drops which are such that the flow velocities of the fluid in the inlet openings downstream of the grating (30) have similar values, and the distribution of the fluid in the inlet openings (204) and in the supply, line downstream of the grating (30) and upstream in the vicinity thereof, is approximately uniform, and characterized in that the grating (30) has perforations distributed non-uniformly over its surface.

2. Heat exchanger according to claim 1, characterized in that the grating (30) has through-perforations (301) with a degree of perforation on its surface which varies over its surface approximately in the opposite direction to the value of the flow velocities at the same locations in the absence of the grating.

3. Heat exchanger according to claim 2, characterized in that the degree of perforation varies over the surface of the grating (30) substantially in inverse proportion to the flow velocities at the same locations in the absence of the grating.

4. Heat exchanger according to claim 1, characterized in that the grating (30) has several juxtaposed regions each having one same degree of perforation on their surfaces, and respective degrees of perforation that differ from one region to an adjacent region.

5. Heat exchanger according to claim 1, characterized in that the grating (30) has at least one region consisting of a notch or a cut-out.

6. Heat exchanger according to claim 1, characterized in that the grating (30) has at least one continuous region with no perforations representing a substantial fraction of its area.

7. Heat exchanger according to claim 1, characterized in that the grating (30) extends over a cross section of the line.

8. Heat exchanger according to claim 1, characterized in that the grating (30) extends over a cross section of the line at right angles to its axis.

9. Heat exchanger according to claim 1, characterized in that the grating (30) is arranged at an angle in the supply line.

10. Heat exchanger according to claim 1, characterized in that the grating (30) extends over the entire area of a cross section of the line.

11. Heat exchanger according to claim 1, comprising a supply line having a tapping (211) exhibiting a circular cross section at right angles to its axis and connected to supply boxes (21) having a semicircular cross section at right angles to their axis, characterized in that the grating (30) is arranged in a supply box near the tapping.

12. Heat exchanger according to claim 1, characterized in that the supply line contains several gratings (30).

13. Heat exchanger according to claim 1, comprising two supply lines, characterized in that each line contains at least one grating (30).

14. Heat exchanger according to claim 1, characterized in that the fluid circulating through the fluid supply line is in the gaseous state.

15. Reboiler-condenser, comprising a heat exchanger according to claim 1.

16. Reboiler-condenser of an air separator unit, comprising at least one heat exchanger according to claim 1.

17. Heat exchanger (2) comprising an exchanger block or a number of aligned exchanger blocks (20), where fluids are circulated in a heat-exchange relationship, at least one face of each block comprising inlet openings (204) for at least one of the fluids, the inlet openings in the same face of each block for this fluid being in communication with the interior space of the same fluid supply box (21) which runs alongside the face thereof, and which communicates with at least one analogous box of an adjacent block if there is one, to form a fluid supply line, the exchanger being characterized in that the fluid supply line contains at least one grating (30) arranged across the line and having through-perforations (301) and solid parts (302) which are distributed in such a way as to create, at locations on the surface of the grating, pressure drops which are such that the flow velocities of the fluid in the inlet openings downstream of the grating (30) have similar values, and the distribution of the fluid in the inlet openings (204) and in the supply line downstream of the grating (30) and upstream in the vicinity thereof, is approximately uniform, and characterized in that the grating (30) extends over an area smaller than a cross section of the line.

18. Reboiler-condenser, comprising a heat exchanger according to claim 17.

19. Reboiler-condenser of an air separator unit, comprising at least one heat exchanger according to claim 17.

* * * * *